US006969061B1

(12) United States Patent
Hierro et al.

(10) Patent No.: US 6,969,061 B1
(45) Date of Patent: Nov. 29, 2005

(54) ROLLER ELEMENT FOR HARDCOPY APPARATUS

(75) Inventors: Lluis Hierro, Barcelona (ES); Macia Sole, Barcelona (ES); Xavier Alonso, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 612 days.

(21) Appl. No.: 09/915,739

(22) Filed: Jul. 26, 2001

(30) Foreign Application Priority Data

Jul. 27, 2000 (EP) ..... 00116344

(51) Int. Cl.[7] ..... B65H 3/06
(52) U.S. Cl. ..... 271/109; 29/895.3; 492/30
(58) Field of Search ..... 271/109, 272, 271/314; 492/28, 30; 29/895.3

(56) References Cited

U.S. PATENT DOCUMENTS

| | | | | |
|---|---|---|---|---|
| 1,576,726 | A * | 3/1926 | Davis | 492/25 |
| 1,728,067 | A * | 9/1929 | Livesey | 26/105 |
| 2,052,566 | A | 9/1936 | Haines | |
| 2,404,159 | A * | 7/1946 | Barber | 492/33 |
| 4,021,894 | A * | 5/1977 | Poterala et al. | 26/105 |
| 4,192,050 | A * | 3/1980 | Appenzeller | 29/895.211 |
| 4,566,162 | A * | 1/1986 | Brands | 26/105 |
| 4,773,143 | A * | 9/1988 | Okamura et al. | 492/44 |
| 5,179,909 | A * | 1/1993 | Sollinger | 118/119 |
| 5,188,273 | A * | 2/1993 | Schmoock | 226/190 |
| 5,421,259 | A * | 6/1995 | Shiba et al. | 101/232 |
| 5,431,321 | A * | 7/1995 | Link et al. | 226/194 |
| 5,607,039 | A * | 3/1997 | Byers et al. | 193/37 |
| 5,645,361 | A | 7/1997 | Mitsushima et al. | 400/636 |
| 5,813,782 | A | 9/1998 | Mason | 400/636 |
| 6,044,556 | A * | 4/2000 | Petitfrere et al. | 29/895.3 |
| 6,145,174 | A * | 11/2000 | Podlesny et al. | 26/99 |
| 6,250,220 | B1 * | 6/2001 | Sainio et al. | 101/228 |
| 6,302,392 | B1 * | 10/2001 | Schaefer et al. | 271/283 |
| 6,536,339 | B2 * | 3/2003 | Negishi | 101/128.4 |
| 6,572,098 | B2 * | 6/2003 | Schaefer et al. | 271/186 |

FOREIGN PATENT DOCUMENTS

| | | | | |
|---|---|---|---|---|
| DE | 3333371 | A1 | 3/1985 | |
| EP | 0616895 | A2 | 9/1994 | |
| EP | 0788888 | A1 | 8/1997 | |
| JP | 05116789 | A * | 5/1993 | B65H 5/06 |
| JP | 10-329969 | | 12/1998 | |
| JP | 11263473 | | 9/1999 | |
| JP | 2000-086004 | | 3/2000 | |

* cited by examiner

*Primary Examiner*—Donald P. Walsh
*Assistant Examiner*—Matthew J. Kohner

(57) ABSTRACT

A printer or other hardcopy apparatus comprises a pinch system (20) comprising a pinch wheel (21) and a drive roller (23) in which the pinch wheel is arranged to contact a print media at locations which move continuously transversely of the direction of media advance. The surface of the pinch wheel may have raised portions (25, 26) extending around the circumference of the roller element and forming continuous bands inclined to the direction of media advance. In a modification, the bands form a helix (45, 46) at each end of the pinch wheel. In a further modification a pinch member (51) comprises two parallel rows of freely-rotatable ball bearings (52) in a holder (53), in which they may be capable of a certain amount of lateral movement.

12 Claims, 3 Drawing Sheets

ROLLER ELEMENT FOR HARDCOPY APPARATUS

FIELD OF THE INVENTION

The present invention relates to a roller element for hardcopy apparatus such as a printer, and in particular to a roller or wheel, e.g. a pinch wheel, for engaging a media as it moves through the apparatus.

BACKGROUND OF THE INVENTION

A general problem in printers, and especially in large format printers, is controlling the paper expansion that occurs when a lot of ink is placed on some media (especially on low cost paper based media). Under certain circumstances, this expansion ends up creating bubbles in the print medium that make the printheads crash against the media (damaging the plot and eventually the print heads).

In existing printers, the pinch wheels continuously engage the print media at the same locations in the direction of the scan axis, i.e. the direction in which the printhead moves during each printing pass. Thus the pinch wheels prevent the paper from expanding laterally, i.e. in the direction of the scan axis, to avoid the formation of the bubbles mentioned above. Accordingly, unwanted concentrations of ink are formed on the medium, which leads to a deterioration in print quality.

The present invention seeks to overcome or reduce the above problem.

SUMMARY OF THE INVENTION

According to a first aspect of the present invention there is provided a roller element which is arranged to be rotatably mounted in a media-advancing device with its axis extending transversely of the direction of media advance such that the roller element engages a media at one or more locations along the direction of said axis, characterised in that, as the media advances, said one or more locations of engagement move(s) continuously in the direction of said axis throughout at least a substantial part of each rotation of the roller element.

The axial movement of the locations of engagement permits the desired local expansion of the paper while maintaining overall contact with the paper.

In preferred embodiments the surface of the roller element has raised portions in the form of continuous bands around the roller element and inclined to the direction of media advance. This enables a continuous engagement of the raised portions with the media and avoids discontinuities.

According to a second aspect of the present invention there is provided a roller element which is arranged to be mounted in a media-advancing device with its axis extending transversely of the direction of media advance such that the roller element engages a media along the direction of said axis, characterised in that the roller element comprises one or more rows of balls mounted for rotation in a holder.

An advantage of the balls is that they can each rotate in the direction of media advance under normal conditions, but can rotate in a relatively inclined direction when lateral expansion of the paper is required.

In a preferred embodiment the balls are mounted with a degree of play, so that a limited displacement can be combined with the lateral rotation.

Thus it will be seen that for arrangements according to the present invention, if one imagines a line drawn on the roller element (i.e. on the raised portion of an element in accordance with the first aspect or on a ball of an element in accordance with the second aspect) connecting points where the roller element becomes disengaged from the media at successive movements in time, the line would be inclined to the direction of media advance.

In accordance with a third aspect of the present invention, there is provided a roller element which is arranged to be mounted in a media-advancing device with its axis extending transversely of the direction of media advance such that different parts of the surface of the roller element successively engage with and then disengage from the media characterised in that a line joining the points on the surface of the roller element which disengage from the media at successive moments in time, is inclined relative to the direction of media advance.

The inclination of the line of disengagement ensures that lateral expansion of the paper is permitted while maintaining overall context with the paper. In addition, discontinuities in the contact are avoided.

According to a fourth aspect of the present invention there is provided a roller element which is arranged to be mounted in a media-advancing device with its axis extending transversely of the direction of media advance characterised in that the roller element permits the media to move transversely while maintaining contact with the media.

BRIEF DESCRIPTION OF THE DRAWINGS

Preferred embodiments of the present invention will now be described, by way of example only, with reference to the accompanying drawings, of which.

DETAILED DESCRIPTION OF THE PREFERRED EMBODIMENTS

Figure 1:
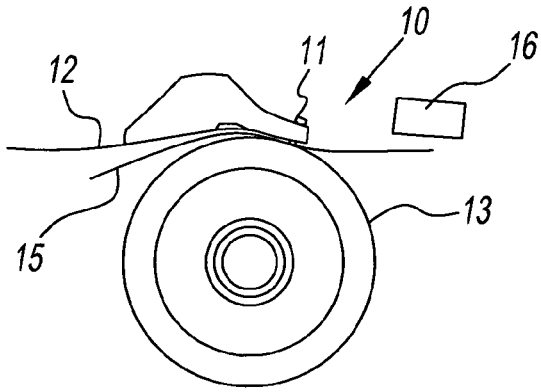
Fig. 1 (Prior Art)
FIG. 1 is a cross-sectional view of the pinch system of a conventional printer or other hardcopy apparatus.
Figure 2:
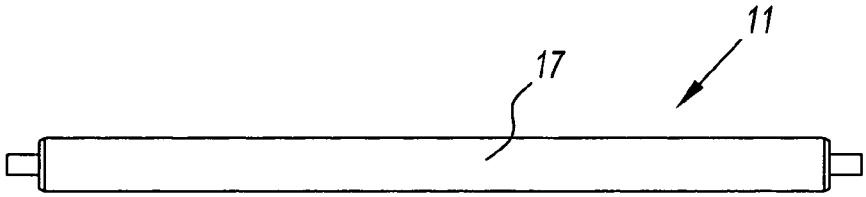
Fig. 2 (Prior Art)
FIG. 2 is a front view of a roller element of the apparatus of FIG. 1.

Referring to the drawings, FIG. 1 shows the pinch system 10 of a prior art printer comprising a cylindrical pinch wheel 11 which is mounted on an arm 12 biased by a spring (not shown) against a drive roller 13. Paper 15 or other print media is pinched as it passes between components 11 and 13 from left to right on its way to a printhead 16. In fact, in existing printers, up to ten pinch wheels 11 are independently mounted and spaced along the scan axis of the printer. Although element 11 is elongated along its axis in the form of a roller, it is still referred to in the art as a pinch wheel; the terms wheel and roller are used in interchangeable fashion in the present specification.

Because the entire surface 17 of pinch wheel 11 is uniformly and constantly in pressure contact with the underlying paper 15, the paper there cannot freely expand laterally (i.e. along the scan axis) in the presence of excess ink. Accordingly "bubbles" arise in the paper in the gaps between adjacent pinch wheels, and these bubbles produce the difficulties discussed in the introduction.

Figure 3:
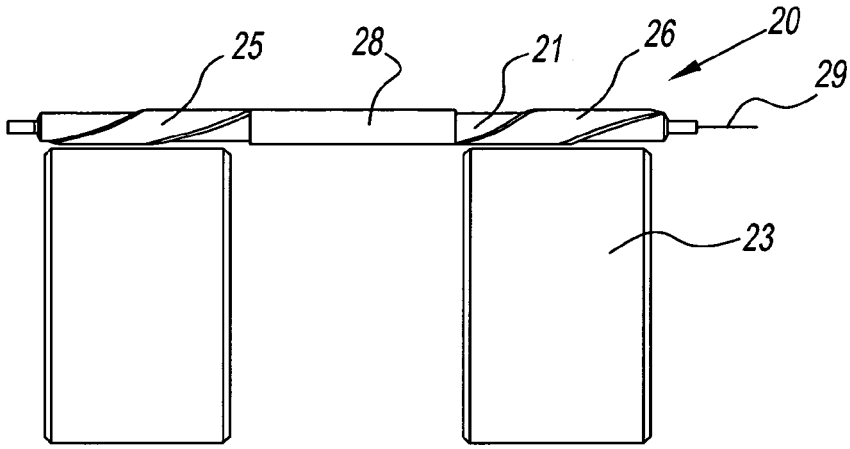
FIG. 3 is a front view of a pinch system in accordance with a first embodiment of the present invention.
Figure 4:
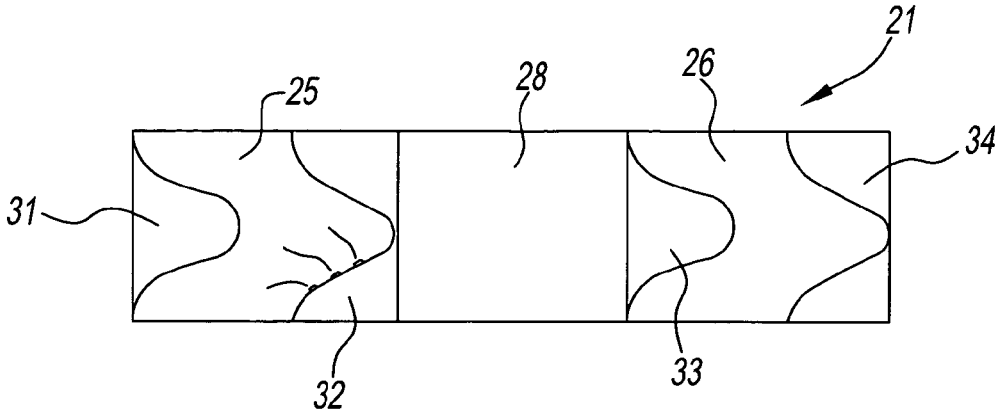
FIG. 4 is a developed view of the surface of the roller element of the system of FIG. 3.

A preferred embodiment of the present invention will now be described with reference to FIGS. 3 and 4 which show a pinch system 20 comprising a roller element in the form of a pinch wheel 21 engaged at each end by a respective drive roller ring 23. The pinch wheel has an axis 29. Instead of having a uniform cross-section along its length, the pinch wheel has a surface which is formed with a raised profile at regions 25 and 26. It will be noted that each region forms a continuous band around the circumference of the pinch wheel 21. The axial length of each band at all points is substantially constant, and the periphery of each band forms a gentle curve at its junctions with the adjacent non-raised regions 31–34. As shown, the surface of central region 28 is raised level with regions 25, 26; however, as will be seen from FIG. 3 the actual level of region 28 is not critical since it is not located directly opposite a part of the drive roller.

Typically, a large format printer has ten pinch wheels 21 spaced at equal intervals along the scan direction, i.e. perpendicular to the direction of medium advance.

As paper or other print medium passes between pinch wheel 21 and drive roller rings 23, on its way to the printhead, the particular locations at which the paper is contacted by the pinch wheel are constantly changing and this moving contact allows the paper to accommodate the expansion caused by a large amount of ink by growing laterally when not pressed by the pinch wheel. Thus at successive moments in time, the parts of raised region 25 which are currently disengaging from, i.e. losing contact with, the media 15 are points a, b, c, along its edge. The line joining points a, b, c, is inclined to the direction of media advance.

The above-described arrangement has various advantages. In particular, by allowing the lateral expansion of the paper defects in the printing are avoided and print quality is maintained. The pinch wheels may be located extremely close to the printhead which leads to good control of the paper. The shape of bands 25, 26 ensures that the contact surface changes without discontinuities. This means that the contact does not suddenly jump in position, which can cause problems in the accuracy of paper advance movements and in print quality. The constancy of the axial length of the bands, and thus their total contact area with the paper, also serves to maintain the accuracy of paper advance movements. The force applied by the pinch wheel to the paper is even and there is no tendency for the pinch wheel to rock from side to side. The areas of bands 25, 26 relative to the adjacent lower regions are sufficiently large to avoid pinch marks on the print medium which can occur with relatively small contact surfaces due to excessive pressure. As shown, band 25 occupies approximately 60% of the total area of band 25 plus adjacent regions 31 and 32. The same applies for band 26 and regions 33 and 34.

Arrangements according to the present invention are particularly suitable for printers in which the pinch wheel system is the sole system for moving the print medium past the printhead, i.e. for printers with no overdrive rollers.

In addition, such printers are frequently required by cost constraints to have a small wrap angle around the drive roller which necessitates an increase in pinch force in order to ensure no slippage of the paper i.e. good paper advance accuracy. In contrast to low pinch forces, which favour lateral paper expansion, a high pinch force can lead to bubble formation. An advantage of arrangements according to the present invention is that they allow lateral expansion of the paper whatever the pinch force and without adding to the cost of the printer. It should be noted that local expansion is permitted while bodily movement of the entire print medium is restricted.

The ten pinch systems 20 of a single printer are independently mounted on separate spring arms.

Various modifications may be made to the above-described arrangement. For example the raised regions 25, 26 may have a wide range of sizes and shapes. Regarding the developed view in FIG. 4, the bands can be thinner or wider, they can have steeper or shallower sides, and/or they can extend over a shorter fraction of the end regions of the pinch wheel. Instead of a single bow in each band around the circumference, there can be two or more bows; moreover, the bows in each band do not need to be identical.

However, to maintain even forces, it is preferable that the band at the right-hand end is substantially identical to, or a mirror image of, the band at the left hand end.

The area of each band 25, 26 relative to the total area of the band and its respective adjacent regions 31, 32 or 33, 34 respectively, may be within the range 30 to 90% and preferably 45 to 75%.

Instead of being formed by a solid area, regions 25 and 26 may be formed by a series of closely-arranged ribs or a plurality of closely-arranged raised dots or pimples of circular or any other convenient shape. For all the above possibilities the regions 31 to 34 could be the raised regions, with regions 25 and 26 not being raised.

The drive roller rings 23 can be replaced by a drive roller extending all the way along the pinch wheel, in which case the pinch wheel is modified so that profiled regions 25, 26 extend along its entire length.

Figure 5:
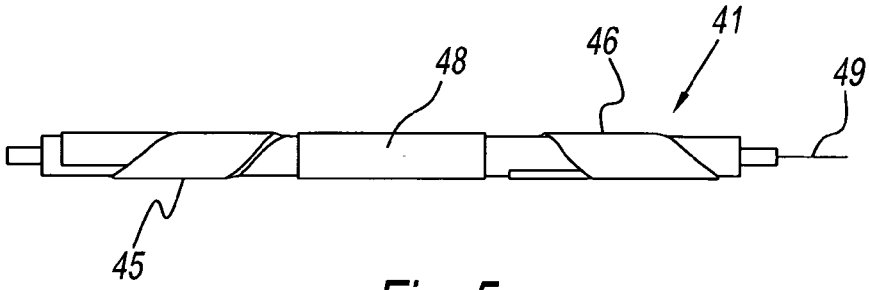
FIG. 5 is a front view of a roller element in accordance with a second embodiment of the present invention.
Figure 6:
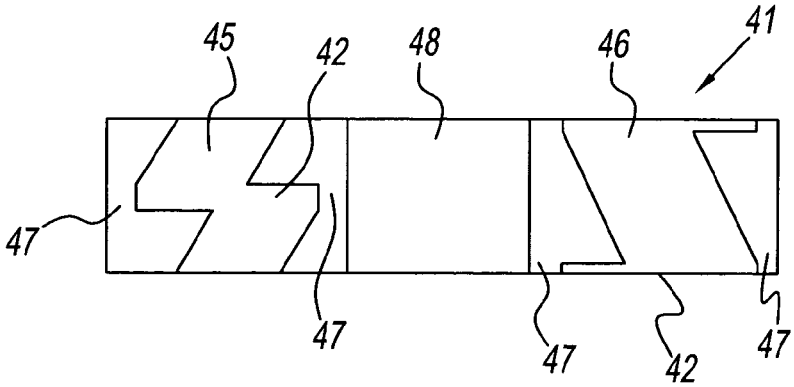
FIG. 6 is a developed view of the roller element of FIG. 5.

The raised profile of the pinch wheel may have other shapes. For example in a second embodiment of the invention, FIGS. 5 and 6, a pinch wheel 41 has raised regions 45, 46 which form a respective helical band at each end. It will be noted that each band has a discontinuity 42 at which it jumps from one end back to the other as the wheel 41 rotates. Although there are gaps 47 at the ends and between the end regions and the central region 48, these do not affect the paper drive, since the drive roller rings are not located opposite the gaps. The pinch wheel 41 has an axis 49.

The second embodiment has the advantages of preventing bubble formation and of having substantially the same area of surface in contact with the paper at all times. It is also cheap to manufacture. However, the discontinuities 42 can adversely affect print quality and the pinch wheel 41 has a tendency to rock as it rotates.

The modifications mentioned in connection with the first embodiment may also be made to the second embodiment. For example, the helices may be thinner or thicker, they may be more or less than one turn at each end of the pinch wheel, and the helices may be of the same hand, although this has a tendency to introduce an unwanted lateral force when the paper is advanced.

As shown, the discontinuities 42 are 180° out of phase with each other; in modifications they can be aligned, or have any intermediate relative disposition.

Where the entire surface of the pinch wheel 41 is engaged by a drive roller, a single helix may be provided along its entire length. A disadvantage of this arrangement, however, is that it also has a tendency to move the paper laterally as it advances; this can be overcome by changing the hand of the helix at the centre of the pinch wheel, but this introduces a further unwanted discontinuity.

Figure 7:
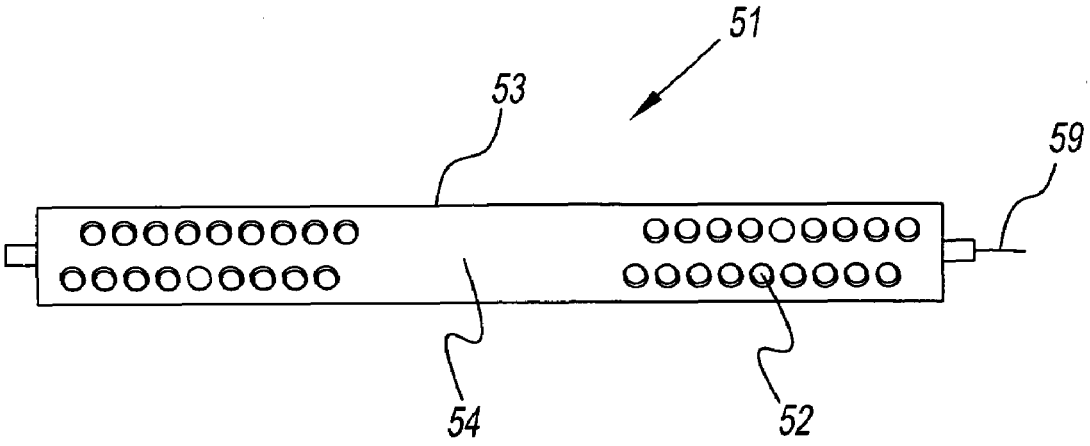
FIG. 7 is a front view of a roller element in accordance with a third embodiment of the present invention.
Figure 8:
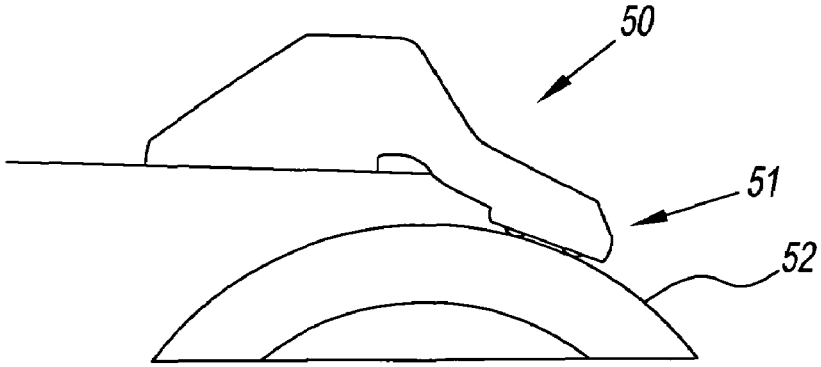
FIG. 8 is a cross-sectional view of a pinch system incorporating the roller element of FIG. 7.

In accordance with a third embodiment of the present invention, FIGS. 7 and 8, a pinch system 50 includes a roller element in the form of a pinch member 51 comprising two rows of steel ball bearings 52 mounted inside a holder 53. The pinch member has an axis 59. The rows have gaps 54 in the centre where there is no opposed drive roller ring 55. The balls are held so that they can move slightly along the row. Thus, in use there is a contact surface area in contact with the paper, but each ball can move from side to side to allow the underlying paper to expand laterally and to avoid the formation of bubbles. In addition to the lateral movement of the balls, rotation of the balls in the same direction, ie about an axis parallel to the direction of paper advance, also allows the paper to expand. Thus, when lateral expansion of the paper is occurring the balls 52 are not rotating about an axis parallel to 59 but about an axis inclined thereto. Accordingly, an imaginary line connecting the points on a ball where it successively contacts and then disengages from the media, would be inclined relative to the direction of media advance.

The pinch member 51 is less suitable for high pinch forces, since the relatively small contact area of each ball can leave marks on the paper. The effects of this can be redeemed by using a softer material for balls 52, e.g. a suitable plastics material or rubber.

The balls in each row can be arranged in sub-groups.

Only a single row of balls may be provided, but this increases the contact pressure and the tendency to leave marks on the paper. The balls can be arranged in three or more rows or in two-dimensional arrays, but the contact becomes less even. The balls may be mounted with no lateral play, in which case expansion of the paper is taken up entirely by rotation of the balls in the same direction.

Although described in connection with pinch wheels, the roller elements in accordance with the invention may constitute an overdrive roller or any other roller device of the drive system of hardcopy apparatus.

What is claimed is:

1. A roller element which is arranged to be rotatably mounted in a media-advancing device with its axis extending transversely of the direction of media advance, the surface of the roller element having at least one raised portion and at least one adjacent non-raised portion, said raised portion being shaped such that, as the media advances and the roller element rotates, said raised portion engages the media along a line of engagement which moves continuously in the direction of said axis throughout at least a substantial part of each rotation of the roller element, wherein said raised portion forms a closed loop around the circumference of the roller element.

2. A roller element according to claim 1, wherein the area of the or each loop lies within the range 30 to 90% of the total area of the loop and its respective adjacent non-raised portions.

3. A roller element according to claim 1, wherein said line of engagement moves continuously in the direction of said axis throughout at least substantially the whole of each rotation of the roller element.

4. A roller element according to claim 3, wherein said line of engagement of the roller element moves continuously in the direction of said axis throughout successive rotations.

5. A roller element according to claim 1, wherein the or each loop has a substantially uniform dimension in the direction of said axis.

6. A roller element according to claim 1, wherein the edges of the or each loop possess no discontinuities.

7. A roller element according to claim 1, wherein a loop is provided at each end of the roller element, the loops being substantially identical.

8. A roller element according to claim 1, wherein the corresponding parts of the loops are aligned along said axis.

9. A roller element according to claims 1, with a surface which has at least one raised portion substantially in the form of a helix around the roller element.

10. A roller element according to claim 9 which has a helix at each end, the helices having opposed hands.

11. A roller element according to claim 1 which is a pinch roller element.

12. A hardcopy device comprising a roller element according to claim 1 biased against a drive roller member with the media being arranged to advance therebetween.

* * * * *